US006971284B2

(12) United States Patent
Owoc

(10) Patent No.: US 6,971,284 B2
(45) Date of Patent: Dec. 6, 2005

(54) COMPACT RATCHET WRENCH WITH ADJUSTABLE JAWS

(76) Inventor: Greg J. Owoc, 106 Galphin Dr., Greenville, SC (US) 29609

( * ) Notice: Subject to any disclaimer, the term of this patent is extended or adjusted under 35 U.S.C. 154(b) by 77 days.

(21) Appl. No.: 10/768,943

(22) Filed: Jan. 30, 2004

(65) Prior Publication Data

US 2005/0166717 A1 Aug. 4, 2005

(51) Int. Cl.[7] ..... B25B 13/00; B25B 13/18

(52) U.S. Cl. ..... 81/58.2; 81/128; 81/129; 81/60; 81/61; 81/62; 81/63; 81/63.1; 81/63.2

(58) Field of Search ..... 81/128, 129, 58.2, 81/60–63.2

(56) References Cited

U.S. PATENT DOCUMENTS

| | | | | | |
|---|---|---|---|---|---|
| 679,929 | A | * | 8/1901 | Webster | 81/63.1 |
| 1,000,277 | A | * | 8/1911 | McCoy | 81/62 |
| 2,884,826 | A | * | 5/1959 | Bruhu | 81/128 |
| 4,608,887 | A | | 9/1986 | Colvin | |
| 4,813,309 | A | | 3/1989 | Kang | |
| 4,911,040 | A | | 3/1990 | Kim | |
| 5,076,121 | A | * | 12/1991 | Fosella | 81/58.4 |
| 5,090,273 | A | * | 2/1992 | Fossella | 81/57.13 |
| 5,207,129 | A | * | 5/1993 | Fossella | 81/63.2 |
| 5,305,670 | A | * | 4/1994 | Fossella et al. | 81/63.2 |
| 5,819,607 | A | * | 10/1998 | Carnesi | 81/128 |
| 5,893,306 | A | | 4/1999 | Owoc | |
| 5,918,511 | A | | 7/1999 | Sabbaghian et al. | |
| 5,996,446 | A | * | 12/1999 | Lee | 81/128 |
| 6,073,522 | A | | 6/2000 | Carnesi | |
| 2003/0140741 | A1 | * | 7/2003 | Chang | 81/128 |

* cited by examiner

*Primary Examiner*—Joseph J. Hail, III
*Assistant Examiner*—Bryan R Muller
(74) *Attorney, Agent, or Firm*—Patent Consultants & Services, Inc.; Robert R. Reed

(57) ABSTRACT

The ratchet wrench of this invention includes a jaw adjustment assembly connected with a jaw and gear assembly carried by a wrench head. Components of the jaw adjustment assembly include a scroll plate inside a cap operated by a jaw adjustment disk located above the cap. The jaw adjuster disk is connected with the scroll plate using a snap ring. Components of the jaw and gear assembly include a pair of jaws supported and guided inside a gear unit with the aid of parallel support rails. The support rails connect the rear unit with the jaws and support the jaw and gear assembly from a wrench head and handle. The two assemblies are pressed and held together by a splined inner surface of the cap interfacing with a splined outer surface of the gear unit. A typical pawl assembly provides the ratchet operation of the ratchet wrench.

16 Claims, 10 Drawing Sheets

COMPACT RATCHET WRENCH WITH ADJUSTABLE JAWS

BACKGROUND OF THE INVENTION

This invention is directed to tools for installing and removing nuts, bolt heads and the like to facilitate assembly and disassembly of various mechanical devices in which components are held together by mechanical fasteners including a nut or head. In particular, the invention is a single compact ratchet wrench tool with adjustable jaw members that are configured to easily operate to provide different ratchet sizes without the need for separate ratchets and a ratchet wrench.

Adjustable sockets have been known in the art for several decades. Typical adjustable sockets are disclosed in U.S. Pat. Nos. 4,813,309; 5,918,511; and 5,996,446. One useful socket is found in U.S. Pat. No. 4,608,887 where a socket support body, comprising parallel slots in which parallel cammed gripping surfaces, slide while supported in an annular and rotatable flange. The drive employed for driving the flange axially is a nut upon a threaded stem located on the socket body. Another useful socket is found in U.S. Pat. No. 6,073,522 where gripping jaws are radially displaced by aligned followers of the jaw members that ride within individual cam grooves of a drive core. The exterior of the drive core is knurled to improve gripping when adjusting the jaw size. While effective, these sockets along with the socket wrench handle require a wide girth and a lengthy axial space in which to operate.

A socket that uses linkage arms in conjunction with threaded adjusters is disclosed in U.S. Pat. No. 4,911,040. This mode of adjustment allows for larger than average jaw sizes. However, the adjustors require complex and bulky mechanical structures.

Making the adjustable socket integral with the wrench handle has the distinct advantage of having a single adjustable socket wrench tool that provides different socket sizes. Ratchet wrench handles that have adjustable jaws are disclosed in U.S. Pat. Nos. 679,929; 1,000,277; 4,813,309; 5,090,273; 5,207,129; and 5,893,306. A typical method used in the art to drive adjustable jaws is a horizontal thread such as the double-threaded stem member, as in patent '309, and a single-threaded stem member, as in patent '306. Another method for adjusting the jaws is disclosed in patent '306. In '306 the jaws travel on tracks or rails and open and close by means of threaded floating cams which urge upon a protruding cam portion integral to the jaw body. Various optional compression springs are included to continually bias the jaws toward an open position.

Of particular interest are the adjustable jaw ratchet wrenches of U.S. Pat. Nos. 5,090,273; and 5,207,129. In patent '129 cam followers of the three jaws lie in cam tracks of an adjusting disk. When the adjusting disk is rotated the jaws will not turn with the adjusting disk but are confined to radial movement. A similar mechanism is disclosed in patent '273 where a cam disc having three cam slots that engage respective posts of the three jaws. Rotating the disk moves the jaws to open and close. Both of these wrenches have a central opening for a threaded shaft of a fastener. These adjustable jaw ratchet wrenches have a wide girth and have relatively small cam followers that do not permit a high torque on the wrench. A relatively short handle of this art helps limit the amount of torque that can be applied.

From the above discussion of the art, it is evident that a need exists to produce an adjustable jaw ratchet wrench that will perform substantially the same function of a ratchet wrench with a socket within the same available space. The jaws must securely grip a wide range of fasteners and include sufficient jaw opening and torque strength capacity so to be of maximum benefit to the user in replacing other wrench tools.

Accordingly, an object of the present invention is to attempt to satisfactorily meet the above requirements and needs by providing a ratchet wrench with a jaw adjustment assembly of rather narrow girth and low-height profile with few and strong reliable parts that function to easily open and close rapidly upon the head or nut of a fastener.

In a second object of the present invention, a strong slotted disk or scroll plate engages an vertical protuberance extending from the top of each jaw to enable relatively large torques to be applied to the wrench.

Another object of the present invention is to provide an overlapping jaw design and a jaw adjuster assembly configured to allow slots in the scroll plate to have a length and radial travel to obtain a wide range of jaw sizes.

A further object of the present invention is to provide a dust proof gear assembly and mechanism including a gear and pawl cavity never exposed to the work environment.

An additional object of the present invention is to provide a coil spring that allows for automatic and continual closure of the jaws.

In yet another additional object of the present invention a pair of support rails are provided which allow for quick assembly and torsional strength of the ratchet wrench.

SUMMARY OF THE INVENTION

The above objectives are accomplished according to the present invention by providing a ratchet wrench having a high torque rating and a compact design. The working components include a jaw adjustment assembly connected with a jaw and gear assembly carried by the wrench head. Components of the jaw adjustment assembly include a scroll plate inside a cap operated by a jaw adjustment disk located above the cap. The jaw adjuster disk is connected with the scroll plate using a snap ring. Components of the jaw and gear assembly include a pair of jaws supported and guided inside a gear unit with the aid of parallel support rails. The support rails connect the rear unit with the jaws and support the jaw and gear assembly from the wrench head. The two assemblies are pressed and held together by a splined inner surface of the cap interfacing with a splined outer surface of the gear unit. However, an internal snap ring between the cap and the gear unit can be used to join all components into a final solid assembly. A typical pawl assembly provides the ratchet operation of the ratchet wrench.

In one embodiment of the invention, a compact ratchet wrench is provided for attaching or removing a threaded fastener. The wrench comprises a wrench head made integral with a wrench handle. A jaw and gear assembly includes first and second jaws and a gear unit. The jaws are carried and guided by the gear unit to translate with respect to one another. The gear unit is carried by the wrench head and is free to ratchet within the wrench head. A jaw adjuster assembly including a jaw adjuster disk connected to a scroll plate is positioned interior to a cap. Rotation of the jaw adjuster rotates the scroll plate within the cap. The scroll plate is made to interface with the jaws. First and second support rails assemble and hold the jaws within the gear unit and rotationally support the jaws and gear assembly connected with the wrench head. The jaws can be opened and closed by rotating the scroll plate when the jaw adjuster assembly is connected with the jaw and gear assembly so that the jaws mesh with the scroll plate.

In one aspect of the invention the first and second jaws both include a jaw proturbance on a top surface and the scroll plate includes first and second cam grooves on a bottom surface, wherein the jaw proturbances mesh with the cam grooves so that rotation of the scroll plate opens and closes the jaws.

In another aspect of the present invention the jaw adjuster assembly includes a coil spring connected between the cap and the scroll plate to bias the scroll plate in a position to keep the distance between the jaws at a minimum when engaged with the fastener.

In another embodiment of the present invention, an adjustable ratchet wrench tool is provided for installing and removing fasteners of various size. The tool comprises a cylindrical wrench head with a pawl cutout carried at one end of an elongated wrench handle. A gear unit is placed inside the cylindrical wrench head to rotate freely within the cylindrical wrench head. A pawl assembly is positioned in the pawl cutout to interface with the gear unit to provide a ratcheted rotation when the wrench handle is rotated in both rotational directions with respect to the gear unit. A pair of jaws, each with a jaw protrusion on a top surface, are held partially inside and guided by the gear unit to translate with respect to one another. A pair of support rails connects the jaws with the gear unit and supports the jaws and the gear unit from the cylindrical wrench head. A scroll plate has a top connector post and a pair of bottom cam grooves. The cam grooves each interface with a respective jaw protrusion of the jaws when the scroll plate is symmetrically positioned above the jaws and the gear unit. A cap having cap splines on an interior surface fits over the scroll plate and interfaces with gear splines on an exterior surface of the gear unit; so that the scroll plate remains in contact with the jaws to receive the jaw protrusions. A jaw adjuster disk is connected with the connector post of the scroll plate so that rotation of the jaw adjuster disk rotates the scroll plate within the cap. Rotation of the scroll plate translates the jaws one with respect to the other to accommodate different fastener sizes.

In yet another aspect of the invention, a snap ring is placed in a disk groove of the jaw adjuster disk to extend into an adjacent scroll plate groove of the connector post of the scroll plate to connect the jaw adjuster disk with the scroll plate so they rotate as a unit within the cap. Simultaneously the scroll plate rotates inside the cap and the adjuster rotates outside the cap.

DESCRIPTION OF THE DRAWINGS

The construction designed to carry out the invention will hereinafter be described together with other features thereof.

The invention will be more readily understood from a reading of the following specification and by reference to the accompanying drawings forming a part thereof, wherein different embodiments of the invention are shown and wherein.

DESCRIPTION OF A PREFERRED EMBODIMENT

The compact ratchet wrench of this invention includes a pair of jaws capable of being adjusted to accommodate a wide range of threaded fastener sizes. The two jaws are disposed within a cylindrical wrench head and are supported and guided by a gear unit to open and close to fit the head or nut of the fastener. The two jaws are made to extend beyond the outer surface of the wrench head to allow a compact design of the ratchet wrench; including a relatively small outer diameter when compared with ratchet wrenches in the industry. Each jaw has a proturbance or nib on the top surface that interfaces with cam groove in a scroll plate. The scroll plate is held against the jaws by a cap and includes a connector post that extends through the cap. A jaw adjuster disk is connected with the connector post of the scroll plate to rotate the scroll plate. Rotation of the scroll plate moves the proturbances of the jaws within the cam grooves to open or close the jaws fo various fastener sizes. A coil spring connected between the cap and the scroll plate biases the jaws against either the head or the nut portions of the fastener. A pawl assembly, located in a pawl cutout of the wrench head, interfaces with a gear surface of the gear unit to ratchet the jaws and attach or remove a fastener.

Figure 1A:
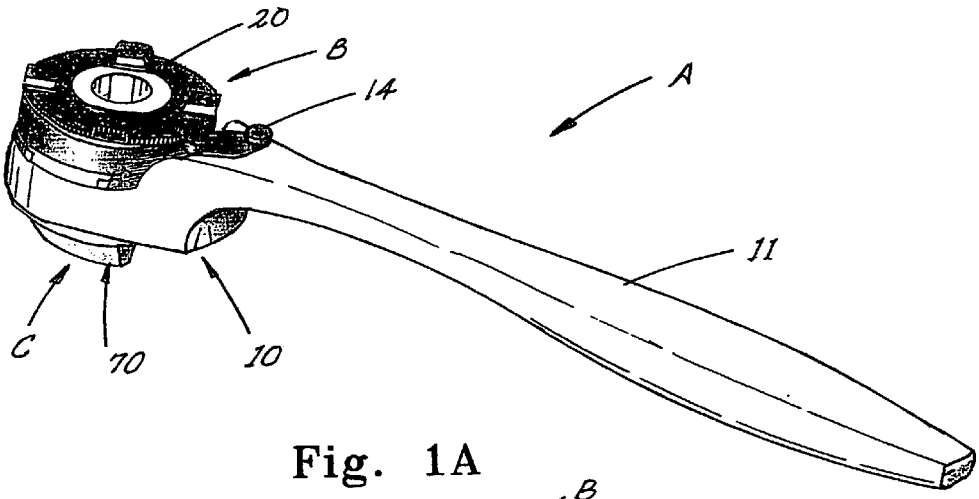
FIGS. 1A and 1B are top and bottom perspective views respectfully of the torque wrench of this invention.
Figure 1C:
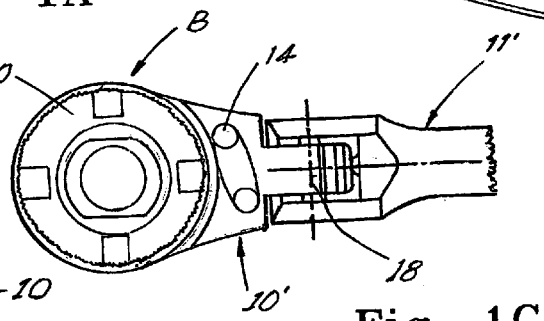
FIG. 1C is a top plan view of the wrench head and partial wrench handle showing a rotation joint to articulate the wrench head with respect to the wrench handle.
Figure 1B:
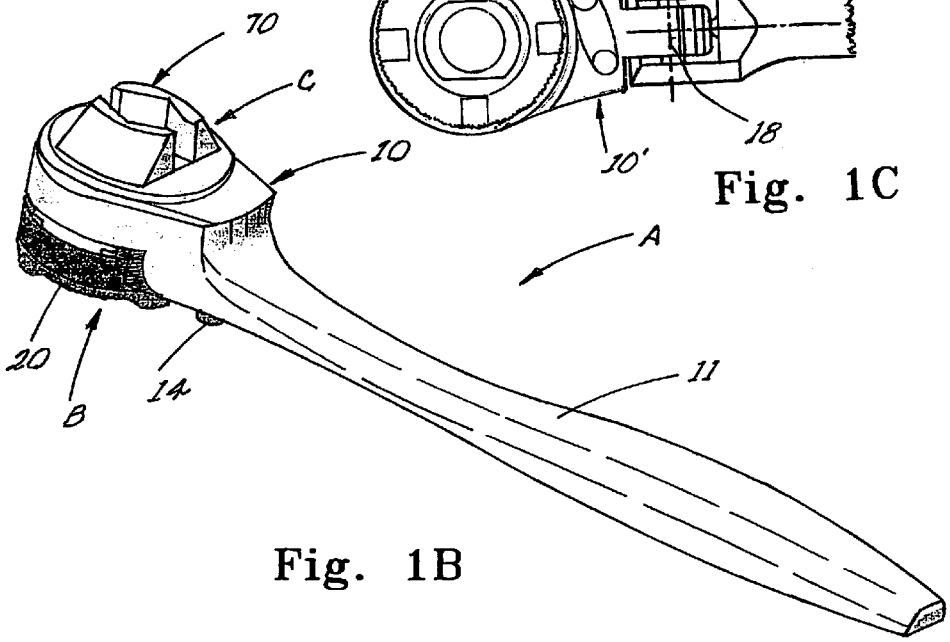

A preferred embodiments of this invention are described in more detail in the following paragraphs by referring to the drawings. Perspective views of a ratchet wrench "A" of this invention are illustrated in FIGS. 1A and 1B. A top perspective view is shown in FIG. 1A and a bottom perspective view is shown in FIG. 1B. The main components of the wrench include a wrench head 10 supported by hand by gripping a wrench handle 11 affixed to the wrench head. The working components of the wrench are supported by the wrench head and include a jaw adjustment assembly "B" on the top and a jaw and gear assembly "C" on the bottom. A pair of jaws 70 are opened and closed to fit a fastener by turning a jaw adjuster disk 20. The jaws can rotate in either rotational direction by rotating a pawl adjuster 14 for either clockwise or counterclockwise rotation. An articulated ratchet wrench is shown in FIG. 1C. A wrench head 10' and a wrench handle 11' have been modified to provide a joint to rotate the head about axis 18 with respect to the handle.

Figure 2:
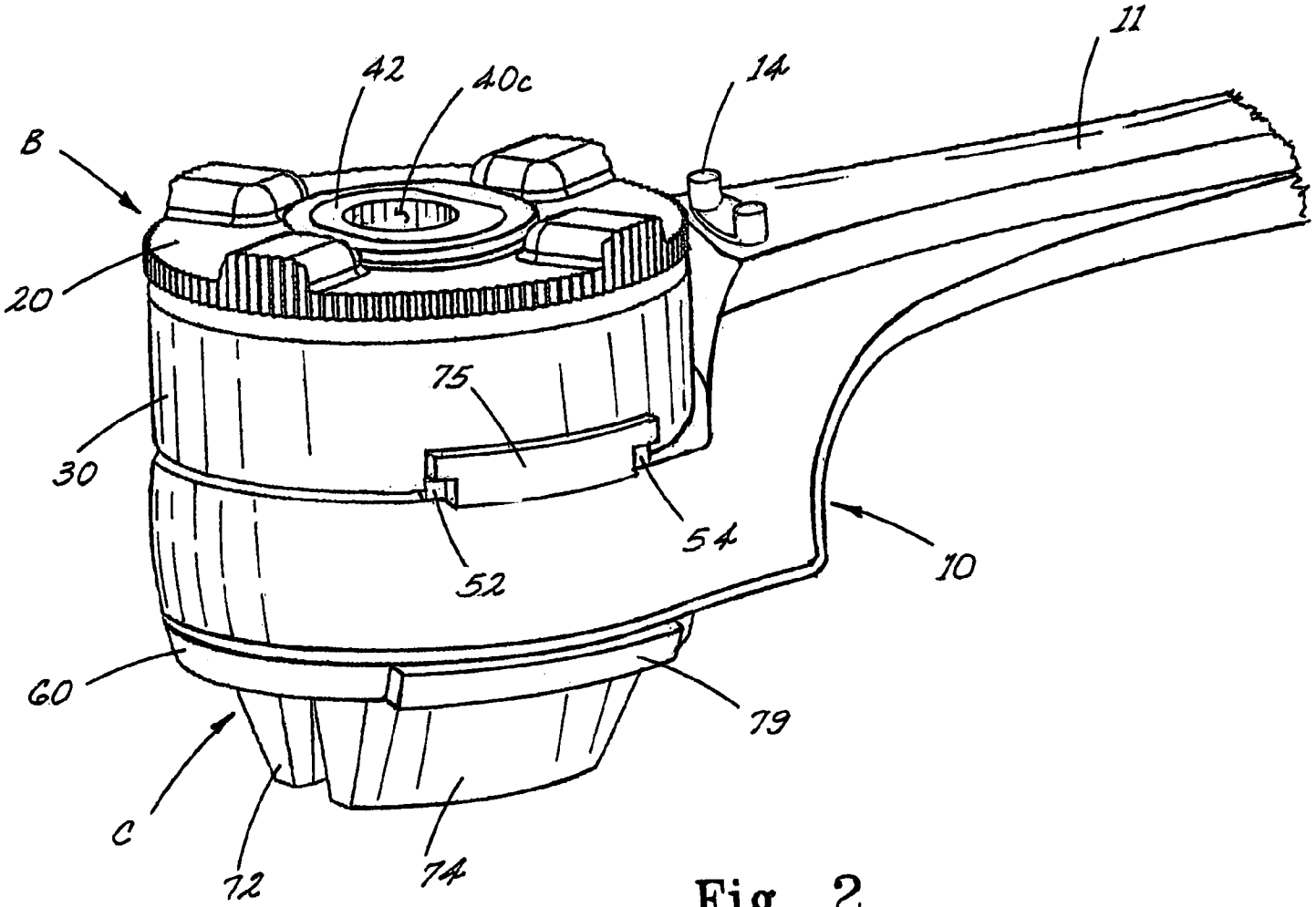
FIG. 2 is an enlarged perspective view of the assembled components at the working end portion of the torque wrench of this invention.

An enlarged perspective view of the wrench head supporting the assembled working components of this invention is illustrated in FIG. 2. Wrench handle 11 is truncated in this view to better show details of jaw adjuster assembly B and jaw and gear assembly C being carried by wrench head 10. The jaws include a first jaw 72 and a second jaw 74 both carried by a gear unit 60 that is carried inside the cylindrical wrench head. Both an upper jaw stabilizer 75 and a lower jaw stabilizer 79 extend from the second jaw. A cap 30 with a cutout for the upper jaw stabilizer is press fit over the top exterior surface (not shown) of the gear unit to help protect the gear surface from debris. A jaw adjuster disk 20 on the top of the cap is connected to a scroll plate connector post 42 so that rotation of the jaw adjuster disk rotates a scroll plate inside the cap. Rotation of the scroll plate causes the first and second jaws to move together for smaller fastener sizes or move apart for larger size fasteners. A scroll plate aperture 40*a* is provided so the ratchet wrench can access a nut of a fastener while the threaded shaft extends through the scroll plate aperture for elongated shaft type fastener applications. A pawl adjuster 14 is rotated to change the rotation of the jaws from clockwise to counterclockwise.

Figure 3:
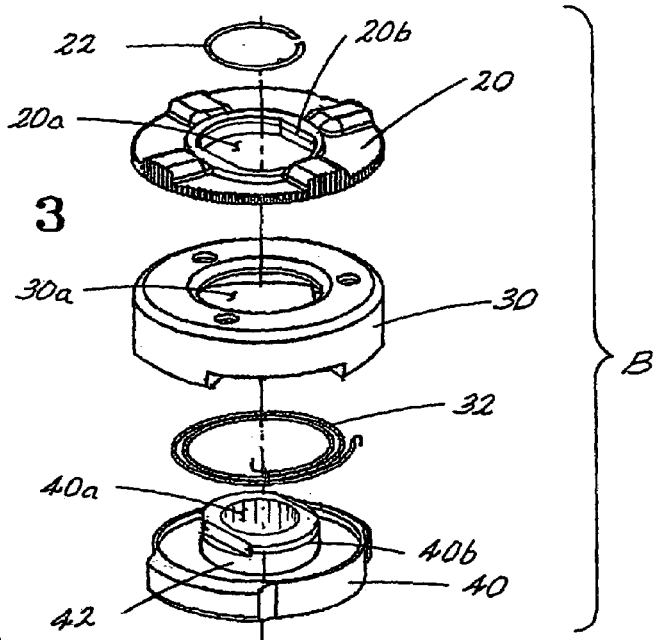
FIG. 3 is an exploded perspective view of the component parts of the head portion of FIG. 2 taken to show the top side of these components.
Figure 4:
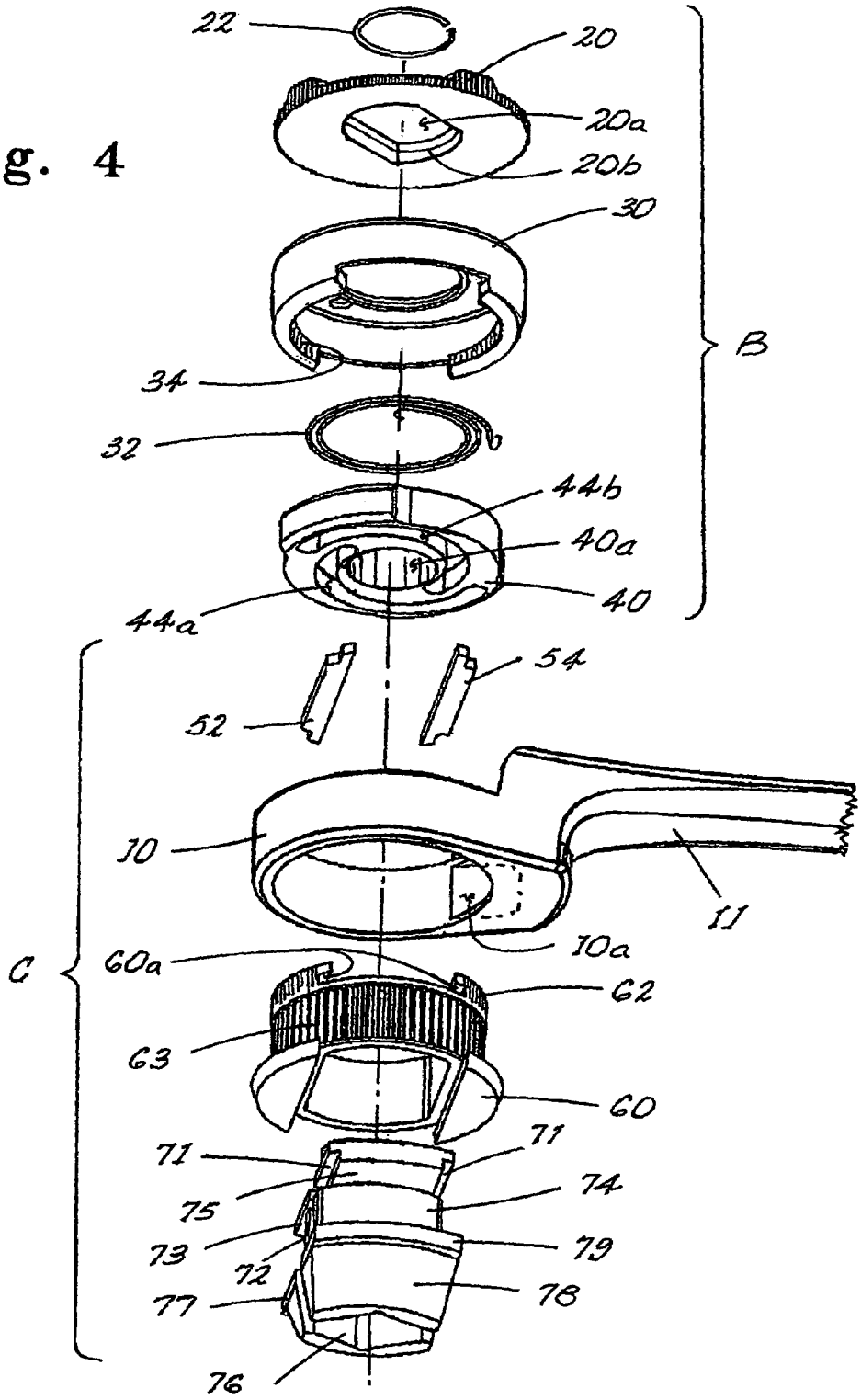
FIG. 4 is an exploded perspective view of the component parts of the head portion of FIG. 2 taken to show the bottom side of the components.

The various working components of the ratchet wrench and their relationship one to the other is best illustrated by the exploded perspective views of FIGS. 3 and 4 The upper group of components are referred to collectively as jaw adjuster assembly B. The lower group of components are referred to collectively as jaw and gear assembly C. Each one of these two assemblies can be separately assembled and press fit together to assemble the ratchet wrench.

Jaw adjuster assembly B of FIGS. 3 and 4 includes a scroll plate having a scroll plate connector post 42. The scroll plate fits inside cap 30 with connector post 42 extending through a cap aperture 30*a*. A coil spring 32 is connected between the cap and the scroll plate. Jaw adjuster disk is connected to the scroll plate connector post above the cap by a snap ring 22. The snap ring is placed in a snap ring slot 20*b* of the jaw adjuster disk to extend into a snap ring slot 40*b* of the scroll plate to make this connection. Assembly apertures 30*b* in the cap are used to assist in assembling the jaw adjuster assembly. The jaw adjuster assembly is now in a condition to be connected with the jaw and the gear assembly, as described later.

Jaw and gear assembly C includes gear unit 60 placed inside wrench head 10 to extend above and below the wrench head. A first jaw 72 and a second jaw 74 of the pair of jaws are placed inside the gear unit with upper jaw stabilizers 73, 75 and lower jaw stabilizers 77, 79 that extend radially outward above and below respectfully of the gear unit and wrench head 10. When the jaws are disposed for the large fastener sizes, these stabilizer components can extend radially beyond the wrench head (see FIG. 2). This feature of the present invention allows the overall diameter of the wrench head to be relatively small when compared with ratchet wrenches in the industry. The jaws are coupled to the gear unit by first and second support rails 52 and 54 respectfully. With the gear unit and jaws positioned in the wrench head, the support rails are inserted in the cutouts formed by gear rail cutouts 60*a* and jaw rail cutouts 70*a*. Support rails extend to rest on a top surface 10*a* of the wrench head and support the jaw and gear assembly as it rotates when the ratchet feature is being engaged. Alternatively, a snap ring on the outside of the gear unit can rotatably secure the gear unit in the wrench head. In addition, the jaws may be inserted into center of the gear unit and rotated and slid into a supporting position by the gear unit without the need for supporting rails. In this case the jaw stabilizers would overlap and ride on the top of the gear unit. The jaw and gear assembly is now in a condition to be connected with the jaw adjuster assembly to complete the assembly of the ratchet wrench.

Figure 6A:
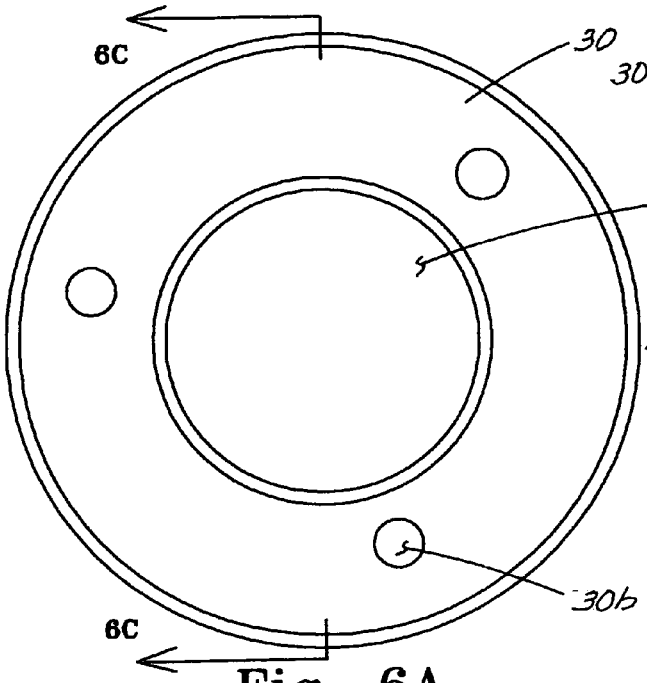
FIGS. 6A and 6B are top and bottom plan views respectfully of the cap component of the head portion of FIG. 2.
Figure 6C:
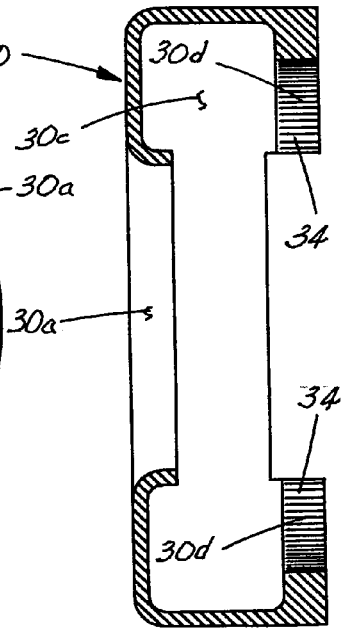
FIG. 6C is a cross-sectional view of the cap component taken along line 6C—6C in FIG. 6A.

The jaw adjuster assembly is connected to the jaw and gear assembly by providing gear splines 62 on the gear unit (FIGS. 3 and 8E) that meshes with a cap splines 34 on the cap (FIGS. 4 and 6C). The two sub-assemblies are pressed together to complete the assembly of ratchet wrench A. However, care must be used to insert jaw protrusions 73*a* and 75*a* of the jaw stabilizers 73 and 75 respectfully of jaws 70 into cam grooves 44*a* and 44*b* respectfully of scroll plate 40. As previously disclosed, rotation of the scroll plate by rotating jaw adjuster disk 20 moves the jaws radially to fit various size fasteners.

Figure 3A:
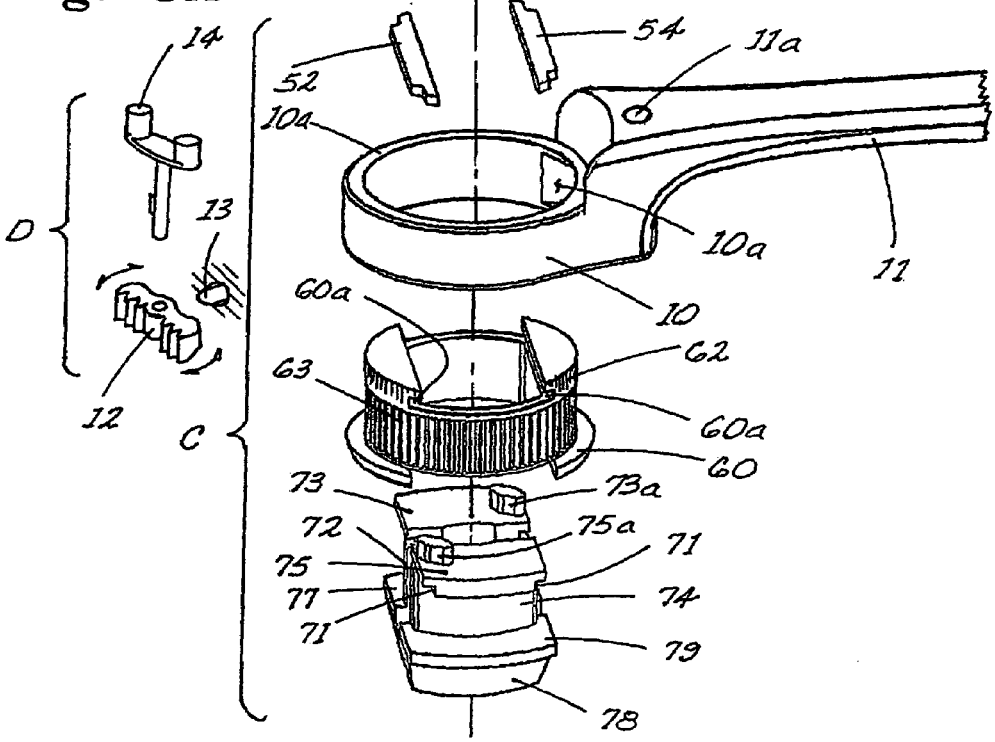
FIG. 3A is a exploded perspective view of the pawl portions of the head portion of FIG. 2.

Ratcheting action of the ratchet wrench is achieved with the aid of a pawl assembly "D", as illustrated in FIG. 3A. The pawl assembly consists of a pawl 12 a spring loaded button 13 and a pawl adjuster 14. The pawl is placed in a pawl cutout 10*a* of wrench head 10 and pawl adjuster is placed in a pawl aperture 11*a* of wrench handle 11 to connect with the pawl. Turning the pawl adjuster rotates the pawl to engage gear surface 63 and ratchet the wrench in one rotational direction or the other depending on what rotation is made in the pawl adjuster. The spring loaded button maintains the pawl in one position until the position of the pawl adjuster is changed.

Figure 5A:
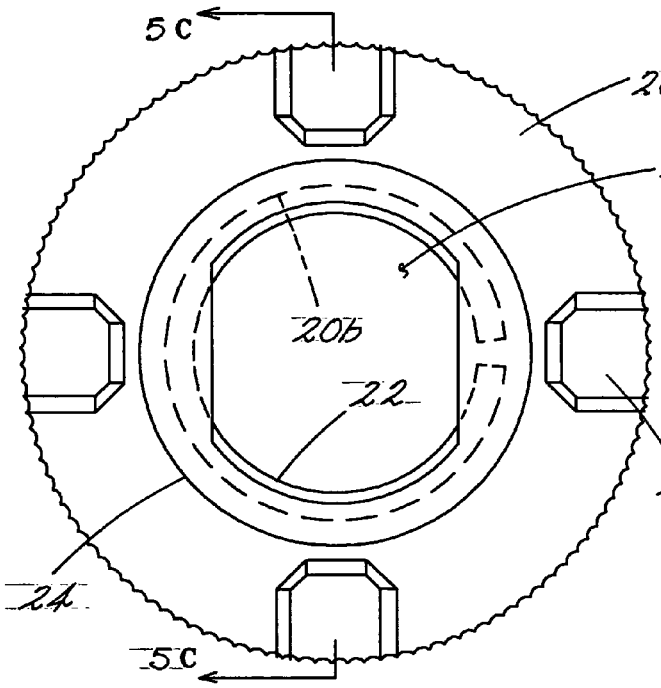
FIGS. 5A and 5B are top and bottom plan views respectfully of the jaw adjuster disk component of the head portion of FIG. 2.
Figure 5C:
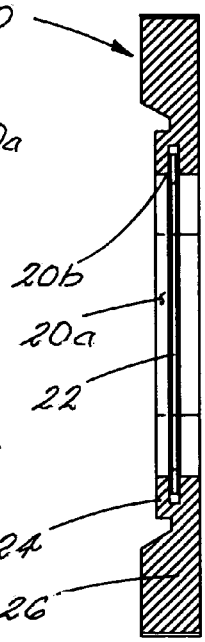
FIG. 5C is a cross-sectional view of the of the jaw adjuster disk component taken along line 5C—5C in FIG. 5A.
Figure 5B:
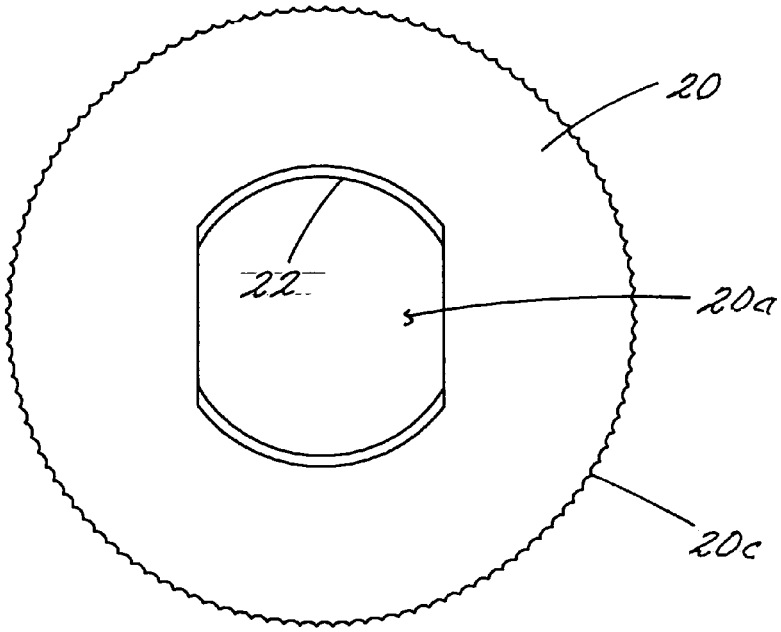

The six main operating components of the ratchet wrench are discussed in more detail by referring to the large scale drawings of these components in FIGS. 5Aa–9D. The jaw adjuster disk is illustrated in FIGS. 5A–5C. A top view of adjuster disk 20 is illustrated in FIG. 5A where a bottom view is shown in FIG. 5B. A cross-sectional view taken along line 5C—5C in FIG. 5A is illustrated in FIG. 5C. The jaw adjuster disk has a central disk aperture 20*a* to receive the connector post of the scroll plate. A connector collar 24 is provided to allow for a snap ring slot 20*b* to be formed adjacent the disk aperture to receive a snap ring 22. The snap ring will be used to connect with the connector post of the scroll plate. Grip hubs 26 and an outer grip surface 20*c* are provided so that the jaw adjuster disk can easily be rotated to adjust the opening of the jaws.

Figure 6B:
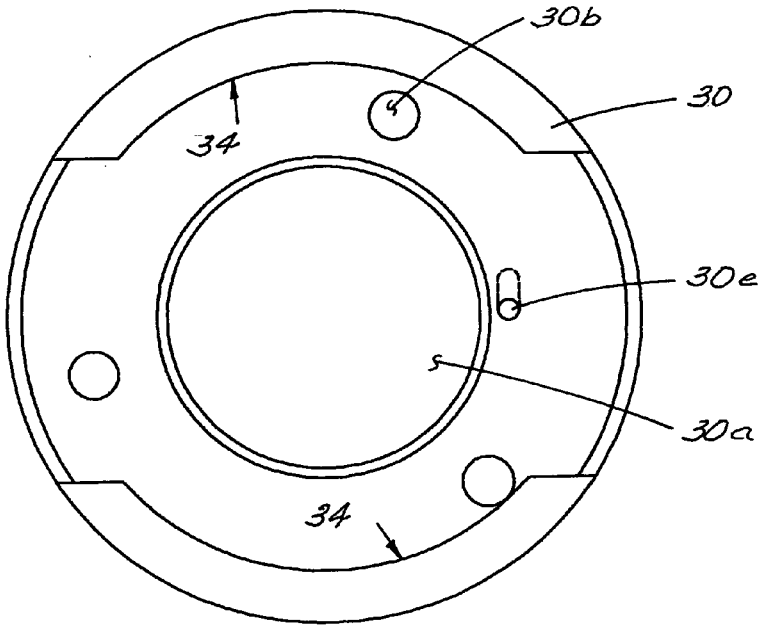

The cap is illustrated in FIGS. 6A–6C. A top view of cap 30 is illustrated in FIG. 6A where a bottom view is illustrated in FIG. 6B. A cross=sectional view, taken along line 6C—6C in FIG. 6A, is illustrated in FIG. 6C. The cap has a center cap aperture 30*a* to also receive connector post 42 of the scroll plate. The cap includes an internal cap void 30*c* to receive the main body portion of the scroll plate so that the scroll plate is free to rotate within the cap. Once again, assembly apertures 30*b* are provided in the cap to assist in the assembly of jaw adjuster assembly B. Cap splines 34 are provided on spline surface 30*d* so that the jaw adjuster assembly can be connected with the jaw and gear assembly. A connector pocket 30*e* is provided to receive one end of coil spring 32.

Figure 7A:
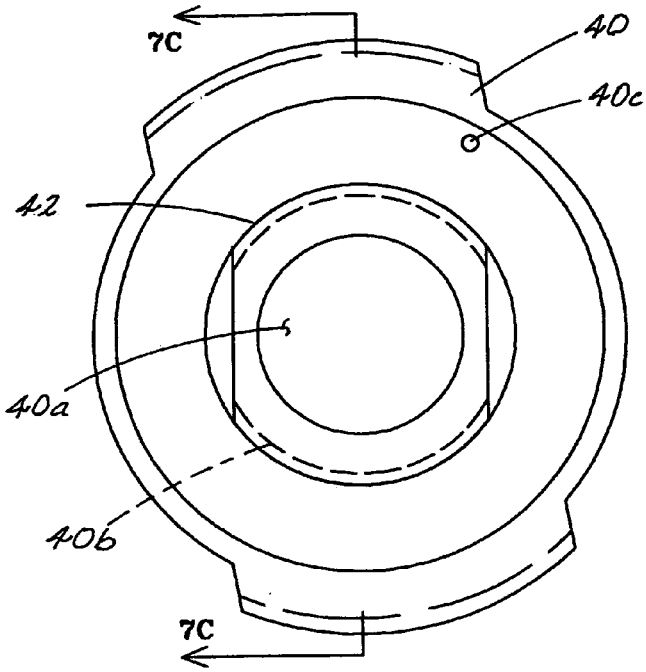
FIGS. 7A and 7B are top and bottom plan views respectfully of the scroll plate component of the head portion of FIG. 2.
Figure 7C:
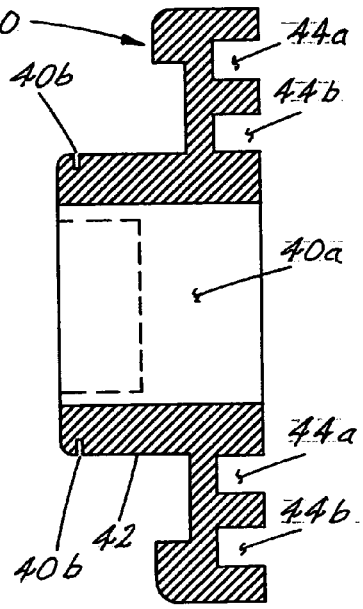
FIG. 7C is a cross-sectional view of the scroll plate component taken along lone 7C—7C in FIG. 7A.
Figure 7B:
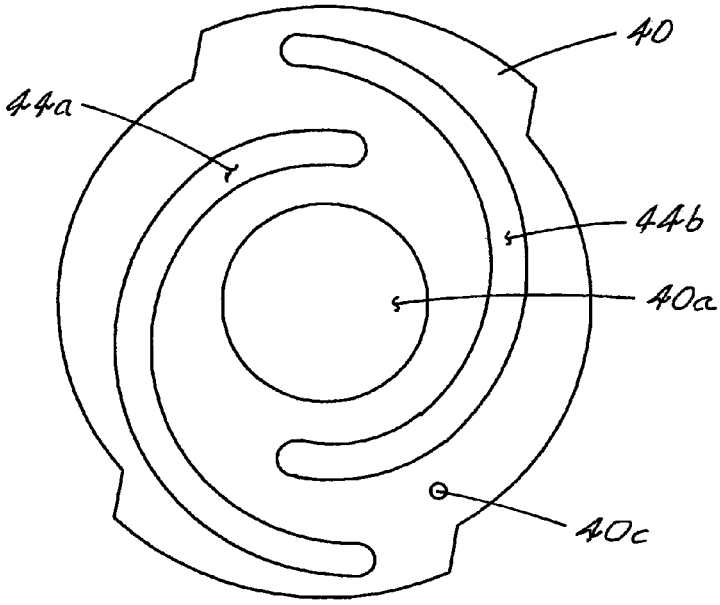

The scroll plate is illustrated in FIGS. 7A–7C. A top view of scroll plate 40 is illustrated in FIG. 7A where a bottom view is illustrated in FIG. 7B. A cross=sectional view taken along line 7C—7C in FIG. 7A is illustrated in FIG. 7C. The scroll plate has a center scoll plate aperture 40*a* to receive the threaded shaft of a fastener. A scroll plate connector post 42 extends upward through the cap and connects with jaw adjuster disk 20. Snap ring slot 40*b* is provided to allow snap ring 22 (see FIGS. 3, 4 and 5A) to enter the slot and connect the scroll plate with the jaw adjuster disk. A first cam groove 44*a* and a second cam groove 44*b* are formed in the bottom surface of the scroll plate. The cam grooves receive the protrusions of the jaws when the ratchet wrench is assembled. The cam grooves are formed to allow the scroll plate to rotate over a large angle. Preferably the scroll plate can rotate about 200 degrees. This large rotation angle is unique in the industry and helps provide for a large translation of the jaws with respect to one another. A coil spring aperture 40*c* is provided for connecting another end of the coil spring to the scroll plate.

Figure 8A:
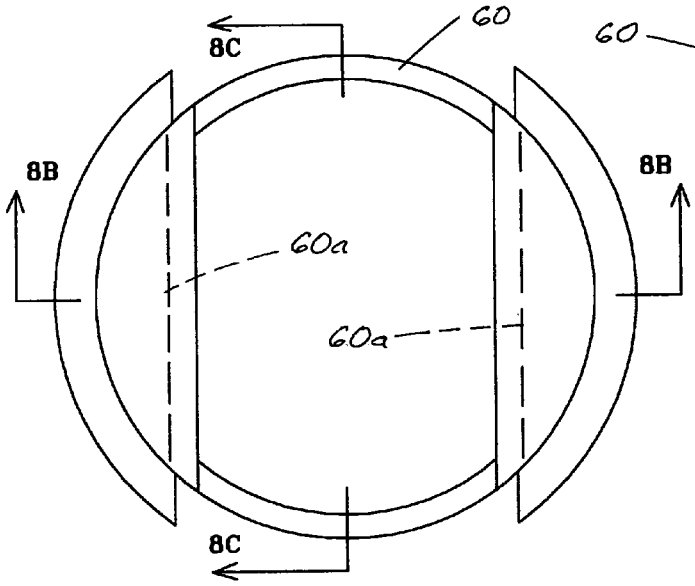
FIGS. 8A and 8D are top and bottom plan views respectfully of the gear unit component of the head portion of FIG. 2.
Figure 8C:
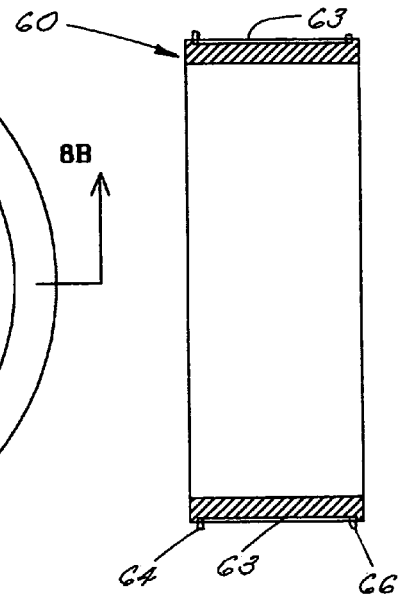
FIG. 8C is a cross-sectional view of the gear component taken along line 8C—8C in FIG. 8A.
Figure 8B:
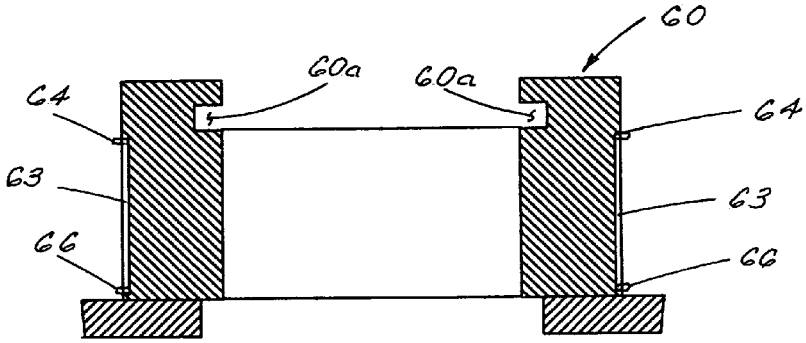
FIG. 8B is a cross-sectional view of the gear unit component taken along line 8B—8B in FIG. 8A.
Figure 8D:
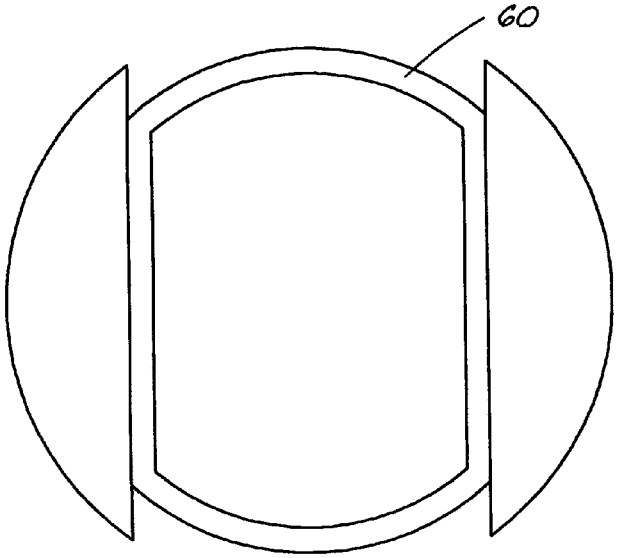
Figure 8G:
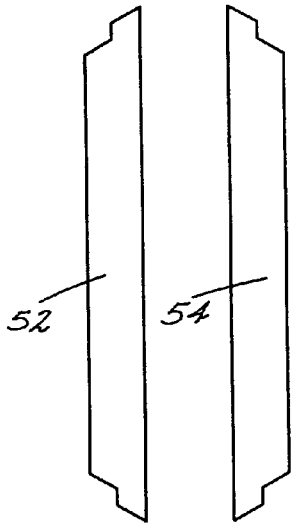
FIG. 8G is a top plan view of the support rails.
Figure 8E:
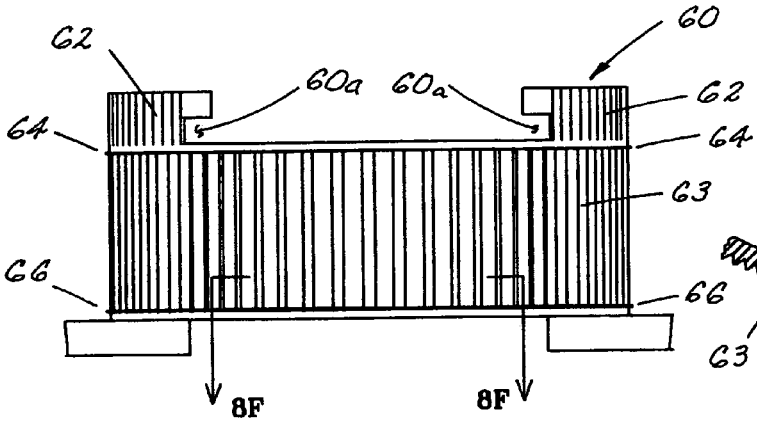
FIG. 8E is an elevation view of the gear unit component of the head portion of FIG. 8A.
Figure 8F:
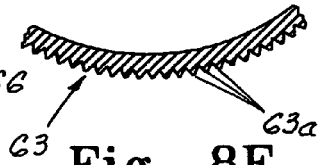
FIG. 8F is a cross-sectional view of a portion of the gear unit taken along line 8E–8D in FIG. 8E.

The gear unit is illustrated in FIGS. 8A–8F. A top view of gear unit 60 is illustrated in FIG. 8A where a bottom view is illustrated in FIG. 8D. A cross-sectional view taken along line 8B—8B is illustrated in FIG. 8B and a cross-sectional view taken along line 8C—8C is illustrated in FIG. 8C. An elevation view showing a gear surface 63 is illustrated in FIG. 8E. The partial section view showing gear teeth 63*a* taken along line 8F—8F in FIG. 8E is illustrated in FIG. 8F. Gear rail cutouts 60*a* are made near the top surface of the gear unit to receive support rails 52 and 54 of FIG. 8G. Gear splines 62 are made on the outer top edge of the gear unit to connect the gear unit with the cap when assembling the jaw adjustment assembly with the jaw and gear assembly. In another aspect of the invention, O-rings are included to protect gear surface 63 from debris and to help retain any lubricant that may be used on the gear surface. A top o-ring 64 is placed adjacent and above the gear surface and a bottom o-ring 66 is place adjacent to and below the gear surface. The O-rings also protect the pawl assembly (FIG. 3A) from debris and help with its lubrication.

Figure 9A:
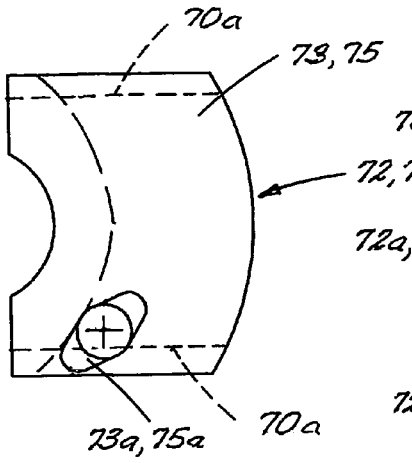
FIGS. 9A and 9B are top and bottom plan views respectfully of a jaw component of the head portion of FIG. 2.
Figure 9B:
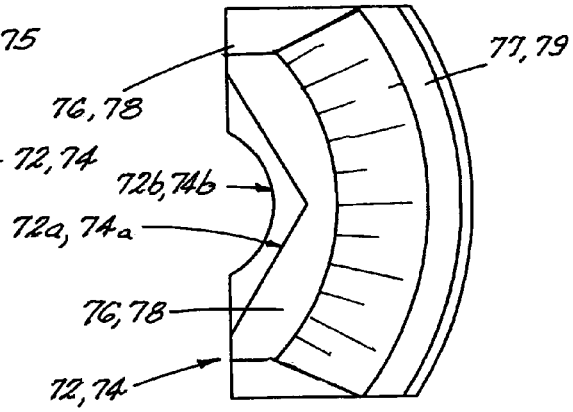
Figure 9C:
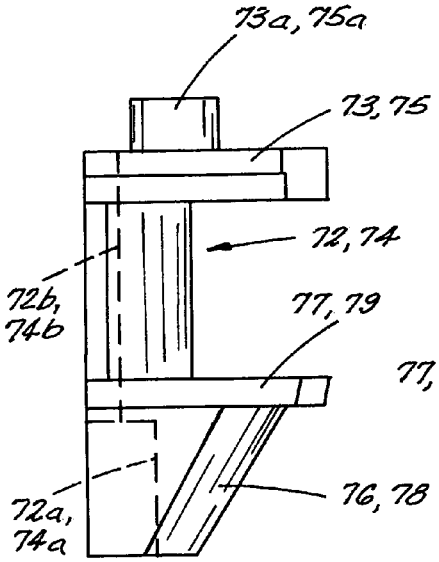
FIG. 9C is a side elevation view of the jaw component of the head portion of FIG. 2.
Figure 9D:
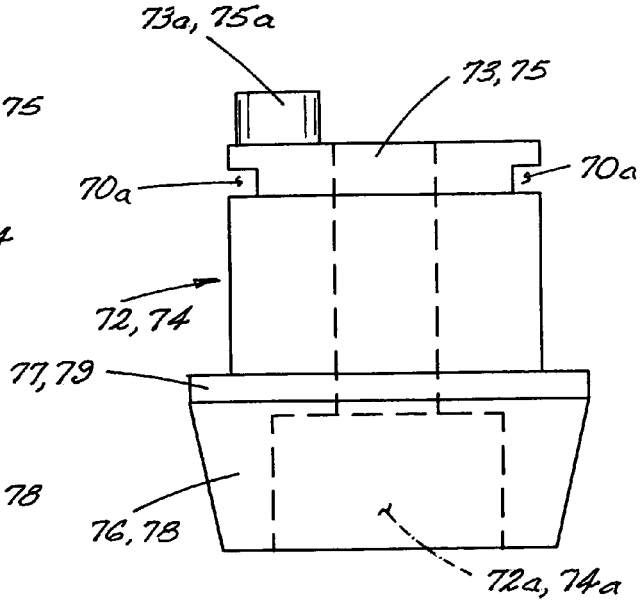
FIG. 9D is a front elevation view of the jaw component of the head portion of FIG. 2.

Either one of a first jaw 72 or a second jaws 74 is illustrated in FIGS. 9A–9D. A top view of the jaw is illustrated in FIG. 9A and a bottom view is illustrated in FIG. 9B. A side elevation view of the one jaw is illustrated in FIG. 9C and a front elevation view of the one jaw is illustrated in FIG. 9D. A jaw proturbance or nib 73*a* or 75*a* extends from a first or second jaw stabilizer portion 73 or 75 respectfully. The jaw proturbances extend into the cam grooves of the scroll plate (FIG. 7B) when the wrench is assembled. The jaw protrusions are made to have a shape that can transmit high forces between the scroll plate and the jaws without failure. Therefore, the high strength ratchet wrench of this invention is uniquely capable of transmitting relatively high torque values to a fastener. A lower jaw portion 76 or 78 is the working part of jaw 72 or 74 to be placed in contact with the fastener. Gripping surface 72*a* or 74*a* interfaces with the fastener to grip and install or remove the fastener when the ratchet wrench is in use. The unique design of the jaws and their supporting components allows a high torque to be applied to the ratchet wrench without the jaws being forced apart when the torque is applied to the fastener. A jaw cutout 72*b* or 74*b* provides an aperture through which the threaded shaft of a fastener can pass.

While a preferred embodiment as well as other embodiments of the invention have been described using specific terms, such description is for illustrative purposes only, and it is to be understood that changes and variations may be made without departing from the spirit or scope of the following claims.

What is claimed is:

1. A compact ratchet wrench for attaching or removing a threaded fastener, said wrench comprising:

a wrench head made integral with a wrench handle;

a jaw and gear assembly including first and second jaws and a gear unit, wherein said jaws are carried and guided by said gear unit to translate with respect to one another and wherein said gear unit is carried by said wrench head and is free to ratchet within said wrench head;

a jaw adjuster assembly including a jaw adjuster disk connected to a scroll plate positioned interior to a cap, wherein rotation of said jaw adjuster rotates said scroll plate within said cap and wherein said scroll plate is made to interface with said jaws; and a snap ring placed in a disk groove of said jaw adjuster disk to extend into an adjacent scroll plate groove of said scroll plate to connect said jaw adjuster disk with said scroll plate so that they rotate as a unit within said cap; and first and second support rails that assemble and hold said jaws within said gear unit and rotationally support said jaws and gear assembly connected with said wrench head, wherein said jaws can be opened and closed by rotating said scroll plate when said jaw adjuster assembly is connected with said jaw and gear assembly so that said jaws mesh with said scroll plate.

2. The wrench of claim 1 including a pawl assembly positioned within a pawl cutout of said wrench head to mesh with said gear unit so that rotation of said wrench handle and head ratchets the connected jaw adjuster assembly and said jaw and gear assembly to attach or remove the fastener.

3. The wrench of claim 2 wherein said pawl assembly includes a pawl and a pawl adjuster for ratcheting the gear unit in both rotational directions with respect to the wrench head and a spring button to hold said pawl to ratchet in a preferred direction.

4. The wrench of claim 1 wherein said first and second jaws both include a jaw proturbance on a top surface and said scroll plate includes first and second cam grooves on a bottom surface, wherein said jaw proturbances mesh with said cam grooves so that rotation of said scroll plate opens and closes said jaws.

5. The wrench of claim 4 wherein said jaw proturbances are offset one to the other so that said cam grooves can have an extended length and said scroll plate can be rotated through a relatively large angle to achieve jaw displacements that accommodate a wide range of fastener sizes.

6. The wrench of claim 5 wherein said first and second cam grooves of said scroll plate extend over a cam length such that said scroll plate can be rotated through a rotational angle of about 200 degrees.

7. The wrench of claim 1 wherein said jaw adjuster assembly includes a coil spring connected between said cap and said scroll plate to bias said scroll plate in a position to keep the distance between said jaws at a minimum when engaged with the fastener.

8. The wrench of claim 1 wherein said connection of said jaw adjuster assembly with said jaw and gear assembly is realized by providing gear splines on an exterior gear unit surface that meshes with a cap splines on an interior cap surface so that pressing said cap over said gear unit completes the assembly process.

9. The wrench of claim 2 wherein said gear unit includes gear teeth surface disposed around the outer surface of the gear unit to mesh with the pawl of the pawl assembly to ratchet the connected jaw adjuster assembly and jaw and gear unit assembly within said wrench head.

10. The wrench of claim 9 wherein said gear unit includes an upper o-ring at the top of the gear teeth surface and a bottom o-ring at the bottom of the gear teeth surface to provide a seal for keeping debris from the gear teeth surface and pawl, as well as provide less need for frequent lubrication of the gear teeth surface.

11. An adjustable ratchet wrench tool for installing and removing fasteners of various size comprising:

a cylindrical wrench head with a pawl cutout carried at one end of an elongated wrench handle;

a gear unit placed inside said cylindrical wrench head to rotate freely within said cylindrical wrench head;

a pawl assembly positioned in said pawl cutout to interface with said gear unit to provide a ratcheted rotation when the wrench handle is rotated in both rotational directions with respect to said gear unit;

a pair of jaws each with a jaw protrusion on a top surface, held partially inside and guided by said gear unit to translate with respect to one another;

a pair of support rails to connect said jaws with said gear unit and to support said jaws and said gear unit from said cylindrical wrench head;

a scroll plate having a top connector post and a pair of bottom cam grooves, said cam grooves each interfacing with a respective jaw protrusion of said jaws when the scroll plate is symmetrically positioned above said jaws and said gear unit;

a cap having cap splines on an interior surface fits over said scroll plate and interfaces with gear splines on an exterior surface of said gear unit so that said scroll plate remains in contact with said jaws to receive said jaw protrusions; and a jaw adjuster disk connected with said connector post of said scroll plate so that rotation of said jaw adjuster disk rotates said scroll plate within said cap, wherein rotation of said scroll plate translates said jaws one with respect to the other to accommodate different fastener sizes.

12. The tool of claim 11 wherein said elongated wrench and said cylindrical wrench heard are made as a single unit.

13. The tool of claim 11 including an articulated joint assembly to connect said elongated wrench handle with said cylindrical wrench head so that an angle between a central axis of the wrench head can vary with respect to an axis of said cylindrical wrench head.

14. The tool of claim 11 including a snap ring placed in a disk groove of said jaw adjuster disk to extend into an adjacent scroll plate groove of said connector post of said scroll plate to connect said jaw adjuster disk with said scroll plate so that they rotate as a unit.

15. The tool of claim 11 including a coil spring connected between said cap and said scroll plate to bias said scroll plate in a position to keep the distance between said jaws at a minimum when in use adjusting the fastener.

16. The tool of claim 11 wherein said pawl assembly includes a pawl and a pawl adjuster for ratcheting the gear unit in both rotational directions with respect to the cylindrical wrench head and a spring button to hold said pawl to ratchet in a preferred direction.

* * * * *